US005778924A

United States Patent [19]

Stangl et al.

[11] Patent Number: 5,778,924

[45] Date of Patent: Jul. 14, 1998

[54] HYDRAULIC CONTROL VALVE BLOCK

[75] Inventors: Helmut Stangl, Horb; Gerhard Beutler, Nagold, both of Germany

[73] Assignee: Brueninghaus Hydramatic GmbH, Eichingen, Germany

[21] Appl. No.: 605,009

[22] PCT Filed: Aug. 29, 1994

[86] PCT No.: PCT/EP94/02857

§ 371 Date: Apr. 26, 1996

§ 102(e) Date: Apr. 26, 1996

[87] PCT Pub. No.: WO95/06818

PCT Pub. Date: Mar. 9, 1995

[30] Foreign Application Priority Data

Aug. 30, 1993 [DE] Germany ..... 43 29 164.3

[51] Int. Cl.[6] ..... F15B 13/02

[52] U.S. Cl. ..... 137/269; 60/443; 137/625.64; 417/213

[58] Field of Search ..... 137/269, 625.64; 60/443; 417/213

[56] References Cited

U.S. PATENT DOCUMENTS 4,699,571 10/1987 Bartholomaus ..... 417/213
4,960,365 10/1990 Horiuchi ..... 137/625.64 X

*Primary Examiner*—Gerald A. Michalsky
*Attorney, Agent, or Firm*—Scully, Scott, Murphy & Presser

[57] ABSTRACT

The invention relates to a hydraulic control valve block in standard configuration having a first control valve (2) and a second control valve (3), functionally cooperating with the first control valve and connected therewith via pressure medium channels (28-31, 33), having a valve piston (5) which is controlled on the one hand by a hydraulic control pressure in a pressure chamber (25) and on the other hand is acted upon by a spring pressure part (7). In order to reduce the construction and installation costs of the control valve block, whilst employing a remotely controllable seat valve, and maintaining its functions, it is provided in accordance with the invention that a supplementary pressure medium channel (36) is formed in the control valve block and that the spring pressure part (7) of the second control valve (3) is replaced by an electrically controllable seat valve (60.1; 60.2) having an electromechanical control part (66.1; 66.2) and at least two hydraulic connections (63.1; 64.1) as valve inlet (63) and valve outlet (64.1; 64.2), and in that the valve piston (5) of the second control valve (3) is deactivated and therewith, at the same time, one (64.1; 64.2) of the two hydraulic connections (63, 64.1; 64.2) of the seat valve (60.1; 60.2) is connected to a hydraulic connection (T) already present and the other hydraulic connection (63) is connected to the supplementary pressure medium channel (36).

7 Claims, 2 Drawing Sheets

HYDRAULIC CONTROL VALVE BLOCK

The invention relates to a hydraulic control valve block in a standard configuration having a first control valve and second control valve which functionally cooperates with the first control valve and is connected therewith through the intermediary of pressure medium channels. The valve block has a valve piston which, on the one hand, is controlled by a hydraulic pressure reigning in a pressure chamber, and on the other hand, is acted upon by a spring-pressure part.

In practice, such a hydraulic control valve block is known in a standard configuration which is economically manufactured in large numbers and for example serves for the regulation of flow and pressure of hydrostatic machines, such as for example axial piston pumps of hydraulic drives for fans of cooling equipment of internal combustion engines. Both control valves of this known control valve block are formed as piston valves with hydraulic control, whereby the first control valve is controlled via two control pressure channels having two different control pressures, which yield a pressure difference proportional to the displacement volume flow of the axial piston pump, and the second control valve is controlled with a control pressure proportional to the working pressure of the axial piston pump; the control being effected in each case against the pressure of a spring pressure part. In order to be able to vary the characteristic of the first control valve remotely there is connected to its control pressure channel having the lower control pressure an external, electrically controlled pressure valve of seat valve construction, by way of a control line, which involves additional constructional and installation effort.

It is the object of the invention to further develop a control valve block of the kind mentioned above such that, whilst maintaining its functions, with the employment of the remotely controllable seat valve, the constructional and installation effort is reduced. The known control valve block is modified in accordance with the invention through exchange of the spring pressure part of its second control valve with the seat valve and the deactivation of the valve piston of the second control valve. At the same time, one of the two hydraulic connections of the seat valve, preferably its outlet, is connected to a hydraulic connection already present, preferably a tank connection of the control valve block, and the other hydraulic connection of the seat valve, preferably its inlet, is connected to the pressure medium channel additionally formed in the control valve block, which pressure medium channel preferably opens into the control channel of the first control valve having the lower control pressure. With a fully closed seat valve, the first control valve retains its function, thus working for example as a pressure difference valve, the control of which with the differential pressure can, through opening of the seat valve, be purposively varied corresponding to the relief of the lower of the two control pressures which yield the differential pressure. As soon as the lower control pressure is reduced to zero, the first control valve functions as pressure valve; it can consequently with the aid of the seat valve be employed both for flow regulation and also for pressure regulation. The control of the seat valve may be effected arbitrarily or in accordance with the field of application of the control valve block in dependence upon various parameters, such as for example the speed of rotation of a drive motor for the pump, the working pressure of the same, with the employment of a corresponding pressure/flow transducer, or the temperature of the cooling medium in the case of employment in a hydraulic drive for a fan of the cooling device of an internal combustion engine. A control valve block modified and formed in this way has, with significantly lesser construction and installation effort as a consequence of the omission of the external, electrically controlled seat valve, as a result of the use of the same instead of the second control valve, the same functionality as the combination of this external seat valve and the control valve block before the modification, namely flow regulation and pressure regulation with remotely controlled variation of the characteristic of the first form of regulation and automatic hydraulic switching from one form of regulation to the other.

The seat valve can, in accordance with a preferred further development, be controlled—additionally to the electrical control—with the hydraulic inlet pressure ruling at its valve inlet, in the direction of its open position. Here, the control part may be of a configuration working either in a switching or proportional manner, and may work against a spring acting upon the seat valve in the direction of the closed position, which expediently has such a characteristic that upon attainment of its response pressure the pressure increase between the beginning of opening and the end of opening (at full throughflow) is as small as possible. It is also possible, however, to form the control part with two proportional magnets, having opposite working directions, of which one acts upon the valve body of the seat valve with force in the direction of the closed position and thus, if appropriate with a relatively weak spring—likewise working in the direction of the closed position—, determines the pressure at which the hydraulic inlet pressure switches the seat valve from the closed position into the open position; the other proportional magnet working upon the valve body of the seat valve in the direction of the open position.

The valve piston may be deactivated either through fixing by means of the seat valve or by means of replacement by a piston which blocks the action of the control pressure on the above-mentioned pressure chamber. Preferably this piston is held by means of the spring in the deactivated position, which spring may be supported on the valve body of the seat valve. Expediently, the spring acts upon the valve body of the seat valve in the direction of the closed position.

The reverse modification, back to a control valve block as described in the above-mentioned state of the art, can be effected in a simple manner through replacement of the seat valve with the spring pressure part of the valve piston which blocks the supplementary pressure medium channel and, if appropriate, replacement of the piston with the valve piston of the piston valve and, if desired, through connection of the external electrically controlled seat valve.

Further features and advantages of the invention can be understood from the following detailed description.

Below, the invention is described in more detail with reference to preferred embodiments and with reference to the drawings, which show:

FIG. 1A a longitudinal section of a control valve block having a piston valve and a seat valve in accordance with the first exemplary embodiment of the invention, FIG. 1B a switching plan of the control valve block according to FIG. 1A, FIG. 2A a longitudinal section of a control valve block with a piston valve and a seat valve in accordance with the second exemplary embodiment of the invention, and FIG. 2B a switching plan of the control valve in accordance with FIG. 2A.

Figure 3B:
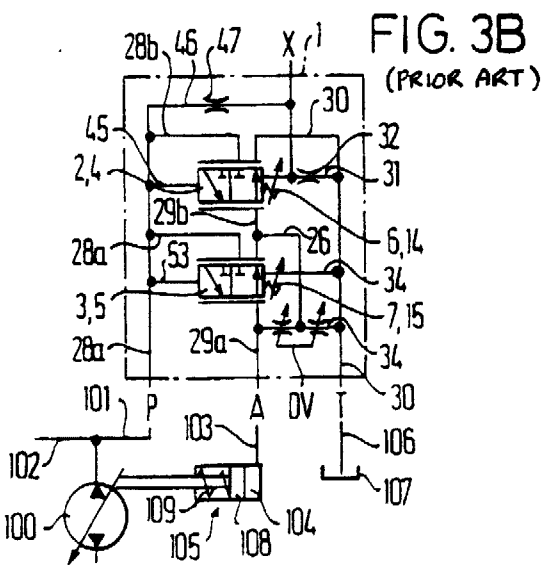
FIG. 3B (PRIOR ART)
FIG. 3B is a switching plan of a control valve block in accordance with FIG. 3A.

First, there will be described the control valve block according to FIGS. 3A and 3B which is known from practice, since it represents the basis construction from which the control valve blocks in accordance with FIGS. 1A, 1B, 2A and 2B are derived, by means of simple modification and supplementing with the supplementary pressure medium channel. Here, FIG. 3A is a longitudinal section of the known control valve block and FIG. 3B is a switching plan of the control valve block according to FIG. 3A.

Figure 3A:
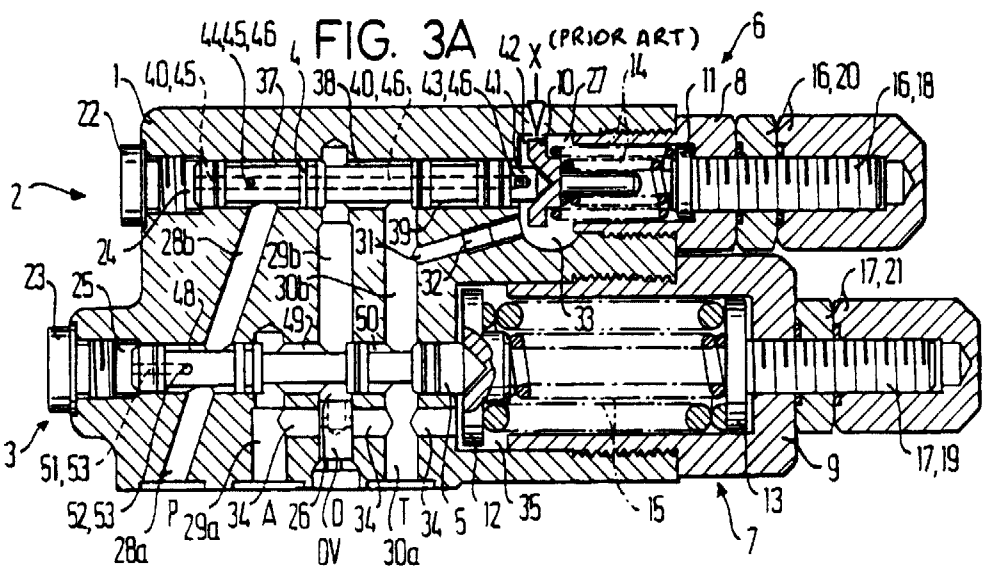
FIG. 3A (PRIOR ART)
FIG. 3A is a longitudinal section with a control valve block which is representative of the prior art.

The control valve block according to FIG. 3A includes a housing 1, a first control valve 2 and a second control valve 3, which are both formed as 3/2-way throttling valves and include each a through-going valve bore in the housing 1, and each a valve piston 4 or 5 displaceably guided in the valve bore, and each a spring pressure part 6 or 7.

Each spring pressure part 6, 7 is screwed into a respective bore widening of the valve bore, opening out at the right-hand end face of the housing 1 in the Figure, and includes a spring housing 8 or 9, a screw/pressure spring arrangement 14 or 15 located between two spring plates 10, 11 or 12, 13 in the spring housing 8 or 9, and a setting member 16 or 17 consisting of a tensioning piston 18 or 19 having an external winding, which engages on the spring plate 11 or 13 external of the housing, on the right in the Figure, and a screw arrangement 20 or 21, screwed onto the tensioning piston 18 or 19, for varying the pretensioning of the screw pressure spring arrangement 14 or 16. Both spring pressure parts 6,7 thus act upon the valve piston 4 or 5 in the direction of an opening of the respective valve bore, closed by means of a closure part 22 or 23, on the left-hand end face of the housing 1 in the Figure, whereby between each closure part 22 or 23 and the end face of the associated valve piston 4 or 5 a hydraulic pressure chamber 24 or 25 is formed.

The housing 1 has five hydraulic connections; a first hydraulic connection P, a second hydraulic connection A, a third, tank connection T, leading to the tank, and a fourth hydraulic connection D (shown only in FIG. 3A) with a pressure medium channel 26 connecting thereto running up to the valve bore of the second control valve, for receiving an adjustable throttle valve DV, as is described in principle in DE 41 32 709. The fifth hydraulic connection X, indicated by an arrow on the upper side of the housing 1 in the Figure, leads direct to the spring chamber 27 of the first control valve 2.

From the hydraulic connection P, there runs in the housing 1 a second pressure medium channel 28, with a first channel section 28*a* up to the valve bore of the second control valve 3 and from this on with a second channel section 28*b* up to the valve bore of the first control valve 2.

From the hydraulic connection A there extends a third pressure medium channel 29, with a first channel section 29*a* up to the valve bore of the second control valve 3, to extend from there with a second channel section 29*b* which is displaced in the valve piston direction, aligned with the first pressure medium channel 26, up to the valve bore of the first control valve 2.

From the tank connection T there runs a fourth pressure medium channel 30, with a first channel section 30*a* up to the valve bore of the second control valve 3 and from this extends with a second channel section 30*b* up to the valve bore of the first control valve 2. The channel sections 30*a* and 30*b* are represented solely in the longitudinal section of the control valve block, but not in the switching plan.

A fifth pressure medium channel 31, having a throttle point 32, connects a connection channel 33, itself connected to the spring chamber 27 of the first control valve 2, with the second channel section 30*b* of the fourth pressure medium channel 30.

A sixth pressure medium channel 34 connects the spring chamber 35 of the second control valve 3 with the first channel sections 30*a*, 26*a* and 29*a* of the pressure medium channels 30, 26 and 29.

The valve piston 4 of the first control valve 2 contains three ring channels which, from left to right in the Figure, are indicated by the reference signs 37, 38 and 39, a longitudinal bore 40 and an extension 41 bearing on the spring plate 10 of the spring pressure part 6, which extension 41 has the same diameter as the valve piston in the region of the ring channels. The annular surface on the valve piston 4, bounded by the extension 41, bounds a further hydraulic pressure chamber 42 of the first control valve 2, which pressure chamber is connected to the connection channel 33. The longitudinal bore 40 runs from the end face of the valve piston 4 on the left in the Figure up to a radial bore 43 which opens at the peripheral surface of the extension 41. A further radial bore 44 connects the longitudinal bore 40 with the peripheral surface of the valve piston 4 in the region of the ring channel 37. The radial bore 44, and the section of the longitudinal bore 40 leading from this to the hydraulic pressure chamber 24, represents a first control pressure channel 45 connected to the second channel section 28*a* of the second pressure medium channel 28.

Likewise, the radial bores 43, 44, the section of the longitudinal bore 40 running between them, represent a second control pressure channel 46, which leads to the further hydraulic pressure chamber 42 and manifests a throttle effect, as is indicated by means of the throttle 47 represented in the switching plan according to FIG. 3B.

The valve piston 5 of the second control valve 3 contains three ring channels which, from left to right in the Figure, are indicated by the reference signs 48, 49, 50, and a longitudinal bore 51 which extends from the end face of the valve piston 5 on the left in the Figure up to a radial bore 52, which opens at the peripheral surface of the valve piston 5 in the region of the ring channel 48. The longitudinal bore 51 and the radial bore 52 represents a control pressure channel indicated by the reference sign 53, which connects the first channel section 28*a* of the second pressure medium channel 28 with the hydraulic pressure chamber 25 of the second control valve 3.

The control valve block in accordance with FIG. 3A and 3B is, in the present exemplary embodiment, employed for the flow and pressure regulation of an axial piston pump 100 of a hydraulic drive (not shown) of a fan for the cooling device of an internal combustion engine (not shown). For this purpose, the hydraulic connection P is connected, via a connection line 101, to a working line 102 which is connected to the outlet of the axial piston pump 100, the hydraulic connection A is connected via a setting pressure line 103 to the hydraulic pressure chamber 104 of a setting cylinder 105 for adjusting the displacement volume of the axial piston pump 100 and the tank connection T is connected via a relief line 106 to the tank 107. The setting piston 108 of the setting cylinder 105 is acted upon by means of a spring 109 in the direction of reduction of the hydraulic pressure chamber 104 and thus of increase of the displacement volume of the axial piston pump 100. The working line 102 leads to a hydraulic motor (not shown) which is arranged in the region of the (likewise not shown) fan wheel of the cooler of the internal combustion engine.

The pressure spring arrangement 15 of the second control valve 3 is set to a higher pressure value than the pressure spring arrangement 14 of the first control valve 2, so that the latter control valve 2 is overcome by the first control valve 3, i.e. only carries out its function of flow regulation below the set pressure value of the pressure spring arrangement 15.

When the axial piston pump 100 is not being driven, the two control valves 2, 3 are located in their respective initial positions shown in the Figure; the valve piston 5 of the second control valve 3 connects, with its ring channels 48, 49 and 50, the respective channel sections 28*a* and 28*b*, 29*a* and 29*b* and 30*a* and 30*b* of the individual pressure medium channels 28, 29 and 30 with one another, without however establishing connection between these pressure medium channels themselves; the valve piston 4 of the first control valve 2 blocks the channel section 28*b* of the second pressure medium channel 28, and with its ring channel 38 connects the channel sections 29*b* and 30*b* of the pressure medium channels 29 and 30 with one another. In this way, with blocked hydraulic connection P, the hydraulic connections A and T of the control valve block are connected with one another and correspondingly the hydraulic pressure chamber 104 of the setting cylinder 105 is relieved to the tank 107, whereby the axial piston pump 100 is set to maximum displacement.

When the axial piston pump 100 is being driven, a part of the displacement volume flow generated thereby flows via the connection line 101, the second pressure medium channel 28, the ring channel 37, the radial bore 44, the longitudinal bore 40, the radial bore 43, the fifth pressure medium channel 41 and the fourth pressure medium channel 30 to the tank 107. Thereby, there arises in the second control pressure channel 46, or at its throttle 47, a pressure difference which is proportional to the displacement volume flow of the axial piston pump 100, which pressure difference prevails in the hydraulic pressure chambers 24 and 42 of the first control valve 2 and acts on its valve piston 4 against the pressure of the pressure spring arrangement 14. As soon as the hydraulic force of this pressure difference exceeds the force of the pressure spring arrangement 14, it displaces the valve piston 4 in the direction of the end position, to the right in the Figure, until it finds itself in force equilibrium and thus takes up a regulation position corresponding to the pressure difference. In this regulation position, the channel section 28*b* of the second pressure medium channel 28 is connected via the ring channel 37 with the channel section 29*b* of the third pressure medium channel 29, whilst the channel section 30*b* of the fourth pressure medium channel 30 is blocked. Correspondingly, the hydraulic pressure chamber 104 of the setting cylinder 105 is connected with the working line 102, so that the working pressure effective in this working line displaces as setting pressure the setting piston 108 against the pressure of the spring 109. By these means, the axial piston pump 100 is for so long swung back towards smaller displacement volume until the displacement volume flow corresponding to the set pressure value (desired value) of the pressure spring arrangement 14 of the first control valve 2 is again reached.

The working pressure in the working line 102 is effective, via the connection line 101, the first channel section 28*a* of the second pressure medium channel 28 and the control pressure channel 53, in the hydraulic pressure chamber 25 of the second control valve 3 and acts upon its valve piston 5 against the pressure of the pressure spring arrangement 15.

As soon as the hydraulic force of the working pressure exceeds the force of the pressure spring arrangement 15, it displaces the valve piston 5 to the right in the Figure, in the direction of the end position, until this piston finds itself in force equilibrium and thus takes up a regulation position corresponding to the working pressure, in which the valve piston 5 connects, with its ring channel 48, the channel section 28*a* of the second pressure medium channel 28 with the channel section 29*a* of the third pressure medium channel 29, and maintains the connection of the channel sections 30*a* and 30*b* of the fourth pressure medium channel 30, and blocks the channel section 29*b* of the third pressure medium channel 29. In this way, the hydraulic pressure chamber 104 of the setting cylinder 105 is connected to the working line 102, so that the working pressure present in this line, as setting pressure, displaces the setting piston 108 against the pressure of the spring 109, with swinging back of the axial piston pump 100 towards smaller displacement for so long until the working pressure corresponding to the set pressure value (desired value) of the pressure spring arrangement 15 is again attained in the working line 2.

Through corresponding opening of the throttle valve DV the setting pressure prevailing in the hydraulic pressure chamber 104 of the setting cylinder 105 can be built up with delay both during the displacement flow regulation by means of the first control valve 2 and also during the pressure regulation by means of the second control valve 3, and thus an abrupt response of the setting piston 108 can be avoided.

There is connected, via the hydraulic connection X of the above-described control valve block, to the hydraulic pressure chamber 42 of the first control valve 2, an external preferably electrically controllable pressure limiting valve (not shown), with which the pressure difference effective at the valve piston 4 can be purposively altered and thus the displacement flow regulation can be influenced.

Figure 1B:
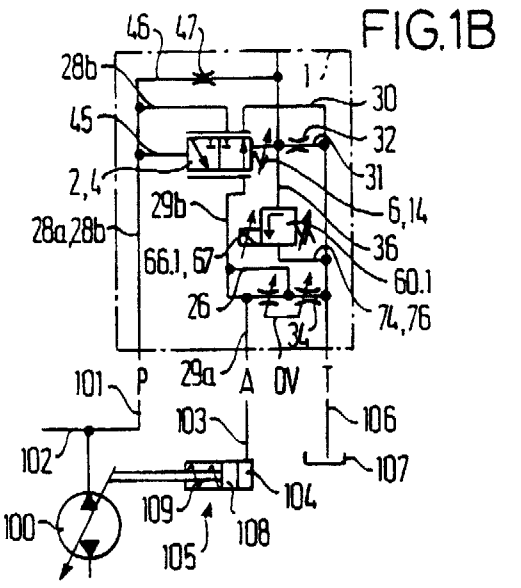
Figure 1A:
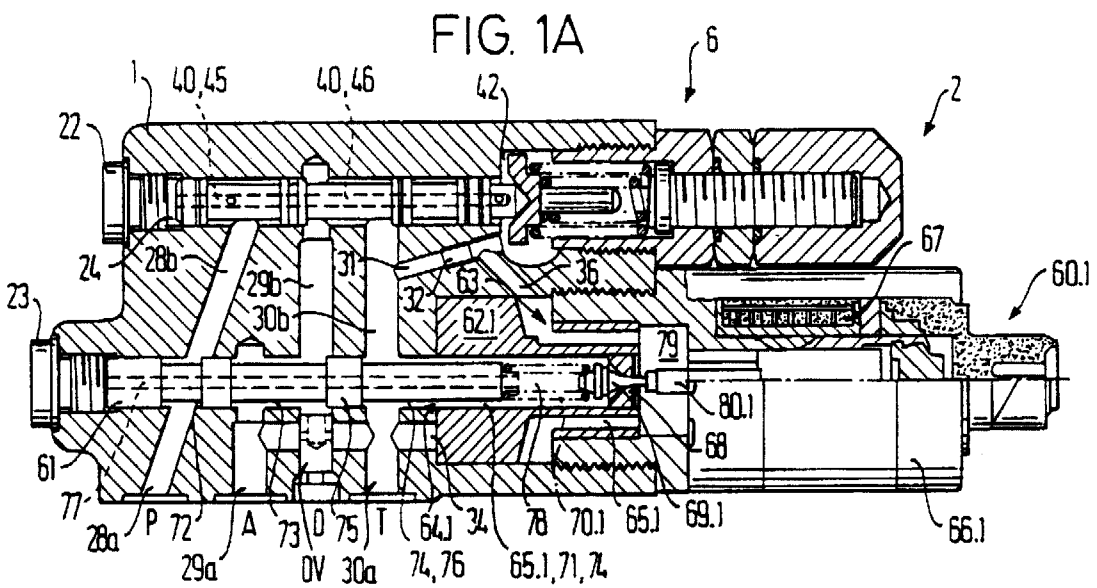

FIGS. 1A and 1B show the control valve block in accordance with the invention according to the first exemplary embodiment, which differs from the known control valve block of FIGS. 3A and 3B—with otherwise similar construction—through a supplementary, seventh pressure medium channel 36, and differs further in that the hydraulic connection X is closed and the second control valve 3 for the pressure regulation is exchanged for a pressure limiting valve 60.1, as is for example connected to the control valve block as external pressure limiting valve via the hydraulic connection X in accordance with FIGS. 3A and 3B.

The seventh pressure medium channel 36 connects the bore widening of the valve bore of the second control valve 3 with the section of the fifth pressure medium channel 31 between the spring chamber 27 of the first control valve 2 and the throttle point 32.

The pressure limiting valve 60.1 is a seat valve the exchange of which is effected in that after screwing out of the spring pressure part 7 from the bore widening of the valve bore of the second control valve 3, and removal of the valve piston 5 out of this valve bore, a piston 61 is placed into the latter and then the pressure limiting valve 60.1 is screwed into the bore widening of the valve bore.

The pressure limiting valve 60.1 includes a valve housing 62.1 in which a throughflow channel 65.1 is formed which connects a valve inlet 63 with a valve outlet 64.1, and also a conventional electromechanical control part 66.1 having a proportional magnet 67, screwed onto the valve housing 62.1 and projecting out of the bore widening. The valve housing 62.1 blocks the part of the sixth pressure medium channel 34 leading to the first channel section 30*a* of the fourth pressure medium channel 30. The valve inlet 63 is formed at such a position in the valve housing 62.1 that it is connected with the seventh pressure medium channel 36. The valve housing 62.1 further includes a cone-like valve seat 68 through which the throughflow channel 65.1 leads, a closure element 69.1 in the form of a conical valve body and a spring 70.1 which urges the closure element 69.1 against the valve seat 68 and thus blocks the throughflow channel 65.1. The spring 70.1 bears against the piston 61 which projects through the valve outlet 64.1 into a valve housing bore 71, whereby the piston is pressed against the closure part 23 and in this way deactivated. The piston 61 contains three rings channels which are indicated in the Figure, from left to right, with the reference signs 72, 73 and 74, and which connect the first channel sections 28*a*, 30*a* or 29*a* of the second and third pressure medium channels 28 and 29 with their second channel sections 28*b*, 30*b* or 29*b* and connect the latter with the first pressure medium channel 26. Since the valve bore in the control valve block housing 1 and the valve housing bore 71 have the same diameter, the ring channel 74—open up to its right end face in the Figure, and thus bounded only on one side by the piston part 75 of larger diameter—forms the part of the throughflow channel 65.1 extending in the valve housing bore 71 and forms in the valve bore of the control valve block housing 1 a connection channel 76 opening into the fourth pressure medium channel 30. A longitudinally running through bore 77 in the piston 61 serves to lead off leakage oil which collects between the closure part 23 and the abutting end face of the piston 61, via the spring chamber 78 of the pressure limiting valve 60.1 and the ring channel 74 to the fourth pressure medium channel 30 and thus to the tank 107.

The end of the closure element 69.1 away from the piston 61 projects into a pressure chamber 79 formed by a widening of the throughflow channel 65.1 and has a smaller sectional surface than an actuating plunger 80.1 of the control part 66.1 against which the closure element 69.1 abuts under the pressure of the spring 70.1.

The control part 66.1 can be arbitrarily controlled and/or controlled in dependence upon various parameters, such as e.g. a control current proportional to the temperature of the cooling medium for the internal combustion engine or a control current proportional to the working pressure in the working line 102.

The control block in accordance with FIG. 1A and 1B can, like that in accordance with FIG. 3A and 3B, be connected with its hydraulic connections P, A and T to the connection line 101, the setting pressure line 103 and the relief line 106 and can be employed for the displacement flow and pressure regulation of the axial piston pump 100.

When the control part 66.1 is not subject to active control, the closure element 69.1, acted upon only by the spring 70.1, blocks the throughflow channel 65.1 of the pressure limiting valve 60.1 and in this way prevents a relief of the control pressure prevailing in the hydraulic pressure chamber 42 of the first control valve 2 and thus prevents a change of the pressure difference effective on the valve piston 4 of this control valve. The latter is thus further a measure of the displacement volume flow of the axial piston pump 100 and consequently makes possible the already described displacement flow regulation by means of the first control valve 2.

With active control of the control part 66.1, the actuating plunger 80.1 is moved outwardly by means of the magnetic field built up in the proportional magnet 67 and displaces the closure element 69.1 over a travel path proportional to the strength of the control current in the direction of the open position. In this way, the hydraulic pressure chamber 42 of the first control valve 2 is connected with the tank 107 via the seventh pressure medium channel 36, the pressure limiting valve 60.1, the connection channel 76, the first channel section 30*a* of the fourth pressure medium channel 30 and the relief line 106. Correspondingly to the degree of opening of the pressure limiting valve 60.1 the control pressure in the pressure chamber 42 is reduced and therewith the displacement flow regulation effected with the first control valve altered.

As soon as the pressure limiting valve 61 is fully open, by means of corresponding active control of the control part 66.1, the control pressure in the pressure chamber 42 reduces to zero, so that the first control valve 2 is controlled now only by the control pressure in the hydraulic pressure chamber 24 proportional to the working pressure in the working line 102 and thus effects pressure regulation in the same manner as the second control valve 3 in the control valve block in accordance with FIG. 3A and 3B.

Figure 2B:
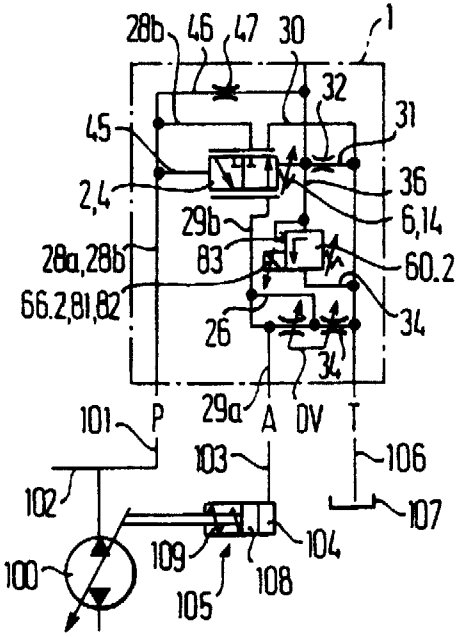
Figure 2A:
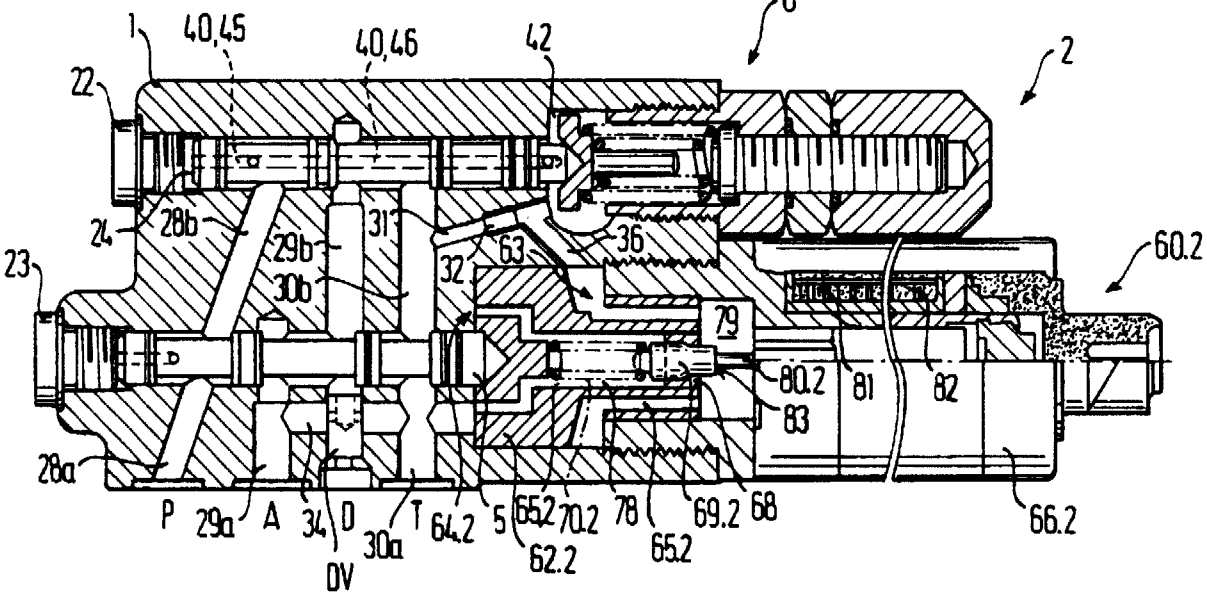

FIGS. 2A and 2B show a control valve block which differs from the control valve block in accordance with FIGS. 1A and 1B—with otherwise similar construction—through the employment of the valve piston 5 in accordance with FIG. 3A instead of the valve piston 61 and through a modified pressure limiting valve 60.2. The control part 66.2 of the pressure limiting valve 60.2 includes a double stroke magnet, i.e. two proportional magnets 81, 82 having mutually proposed operating directions, and an actuating plunger 80.2 having a smaller cross-sectional surface than the actuating plunger 80.1 in accordance with FIG. 1A. The closure element 69.2 of the pressure limiting valve 60.2 includes, through being formed with larger cross-sectional surface than the closure element 69.1 according to FIG. 1A, a measurement surface 83 which can be acted upon by the pressure medium in the pressure chamber 79. Further, the pressure limiting valve 60.2 includes, in comparison with the pressure limiting valve 60.1, a modified valve housing 62.2, and a weaker spring 70.2.

The spring 70.2 is supported against the valve housing 62.2 which presses the valve piston 5 against the closure part 23 and thus deactivates it.

Because of the employment of the double stroke magnet 81, 82, the actuating plunger 80.2 is connected with the closure element 69.2. The proportional magnet 81 has the same working direction and function as the proportional magnets 67 in accordance with FIG. 1A, i.e. the magnetic field built up thereby when it is actively controlled moves the actuating plunger 80.2 and thus the closure element 69.2, through a path distance corresponding to the strength of the control current in the direction of the open position. In accordance with the strength of the control current, the pressure limiting valve 60.2 can thus be partially or fully opened and thus the displacement flow regulation effected by the first control valve 2 with blocked pressure limiting valve 60.2 can be influenced or switched over to pressure regulation.

The proportional magnet 82 has the opposite working direction to the proportional magnet 81 and serves, when the proportional magnet 81 is not actively controlled, to press the closure element 69.2 against the valve seat 68 with a force corresponding to the control current, i.e. to set the pressure desired-value at which the inlet pressure prevailing in the pressure chamber 79 and acting upon the measurement surface 83 opens the closure element 69.2 against the pressure of the spring 70.2; since the spring 70.2 has a relatively low spring stiffness and thus serves as a switch spring, the closure element 69.2 opens completely and thereby switches the first control valve 2 from the displacement flow regulation over to the pressure regulation if the hydraulic force of the inlet pressure acting upon the measurement surface 83 exceeds the force with which the actively controlled proportional magnet 82 presses the closure element 79.2 against the valve seat 68.

The switch over from the displacement flow regulation to the pressure regulation is thus effected in the same manner as with the control valve block in accordance with FIG. 3A and 3B under direct influence of the working pressure (neglecting the relatively slight pressure difference at the throttle 47).

Since the valve piston 5 in accordance with FIG. 3A is employed, the connection channel 76 is omitted; instead, the throughflow channel 65.2 is connected to the sixth pressure medium channel 34 leading to the tank connection T via the valve outlet 64.2.

We claim:

1. Hydraulic control valve block having a first hydraulic connection (P), for connection to a working line (102), a tank connection (T), for connection to a tank (107), a second hydraulic connection (A), for connection to a setting pressure line (103), a control valve (2) having a first hydraulic pressure chamber (24) connected with the first hydraulic connection (P) and a second hydraulic pressure chamber (42) connected via a throttle point (32) with the tank connection (T), which—in accordance with the position of a displaceable valve piston (4) arranged between the hydraulic pressure chambers (24, 42) - connects either the first hydraulic connection (P) or the tank connection (T) with the second hydraulic connection (A), a throttle (47) provided between the first (24) and second (42) hydraulic pressure chambers of the control valve (2) and a pressure limiting valve (60.1, 60.2) arranged between the second hydraulic pressure chamber (42) of the control valve (2) and the tank connection (T), having a control part (66.1, 66.2) actuating a closure element (69.1, 69.2), whereby upon active control of the control part (66.1, 66.2) the closure element (69.1, 69.2) is displaced in the direction of its open position and thus the pressure limiting valve (60.1, 60.2) connects the second hydraulic pressure chamber (42) of the control valve (2) with the tank (107) via the tank connection (T).

2. Hydraulic control valve block according to claim 1, wherein said pressure limiting valve (60.1, 60.2) is a seat valve.

3. Hydraulic control valve block according to claim 2, wherein a spring (70.1) acts upon the closure element (69.1) of the pressure limiting valve (60.1) in the direction towards a closed position.

4. Hydraulic control valve block according to claim 2 or 3, wherein said pressure limiting valve (60.1; 60.2) has a valve inlet (63) connected to a supplementary pressure medium channel (36) and a valve outlet (64.1; 64.2) connected to the hydraulic connection (T).

5. Hydraulic control valve block according to claim 4, wherein the control valve (2) is a differential pressure valve; two control pressure channels (45, 46) having two different control pressures yielding a differential pressure for controlling said differential pressure valve; and the supplementary pressure medium channel (36) being connected to said one control pressure channel (46) having the lower control pressure and leading to said control valve (2).

6. Hydraulic control valve block according to claim 2, wherein the closure element (69.2) of said pressure limiting valve (60.2) in addition to being controlled by the control part (66.2), is acted upon by the hydraulic inlet pressure of the pressure limiting valve (60.2) in the direction towards an open position.

7. Hydraulic control valve block according to claim 6, wherein the control part (66.2) comprises two proportional magnets (81, 82) having two mutually opposite working directions, one of said magnets (82) applying a force to said closure element (69.2) of said pressure limiting valve (60.2) in the direction towards a closed position, and the other of said magnets (81) acting upon said closure element (69.2) of the pressure limiting valve (60.2) in the direction towards an open position.

* * * * *